US007638180B2

(12) United States Patent
Nebesnak

(10) Patent No.: US 7,638,180 B2
(45) Date of Patent: Dec. 29, 2009

(54) RIBBED JOINT PATCH FOR SINGLE PLY ROOFING MEMBRANES

(75) Inventor: Edward Nebesnak, Mine Hill, NJ (US)

(73) Assignee: Building Materials Investment Corporation, Wilmington, DE (US)

( * ) Notice: Subject to any disclaimer, the term of this patent is extended or adjusted under 35 U.S.C. 154(b) by 103 days.

(21) Appl. No.: 11/055,148

(22) Filed: Feb. 10, 2005

(65) Prior Publication Data

US 2006/0177617 A1 Aug. 10, 2006

(51) Int. Cl.

| | |
|---|---|
| ***B32B 9/00*** | (2006.01) |
| ***E04B 5/00*** | (2006.01) |
| ***B32B 7/00*** | (2006.01) |

(52) U.S. Cl. ..... 428/40.1; 428/41.3; 428/42.1; 428/119; 428/120; 52/408; 52/411; 52/412; 52/413

(58) Field of Classification Search ..... 428/40.1, 428/40.3, 41.3, 42.1, 44, 51, 119, 120; 52/408, 52/411, 412, 413

See application file for complete search history.

(56) References Cited

U.S. PATENT DOCUMENTS

| | | | | |
|---|---|---|---|---|
| 3,373,537 | A * | 3/1968 | Blayden | 52/287.1 |
| 5,204,148 | A * | 4/1993 | Alexander et al. | 428/41.8 |
| 5,800,891 | A * | 9/1998 | Wasitis | 428/42.2 |
| 2006/0099370 | A1 * | 5/2006 | Glass | 428/40.1 |

* cited by examiner

*Primary Examiner*—Patricia L Nordmeyer
(74) *Attorney, Agent, or Firm*—William J. Davis; Sills Cummins & Gross P.C.

(57) ABSTRACT

A ribbed roof T-joint or butt joint patch is provided for application to intersecting and overlapping portions of a single ply membrane of different heights. When applied to the joint formed by the intersecting and overlapping membranes, the ribbed joint patch having an adhesive layer conforms to the void formed by the joint and assures a water tight seal. A method of making a roof joint patch and a method of applying a ribbed joint patch to a void formed by intersecting and overlapping membranes are also disclosed.

54 Claims, 4 Drawing Sheets

RIBBED JOINT PATCH FOR SINGLE PLY ROOFING MEMBRANES

FIELD OF THE INVENTION

The present invention relates to roofing materials. More specifically, the present invention is directed to a patch to fill voids created by overlapping roofing membranes.

BACKGROUND OF THE INVENTION

Single ply membranes are roofing membranes that are field applied using just one layer of membrane material (either homogeneous or composite) rather than multiple layers. Oftentimes as a result of the overlapping intersection of two, three or four sheets of the membrane, a joint is created.

Current joint patches are flat membranes with the butyl or similar adhesive applied to one side with a release liner. Often, when applied to intersecting and overlapping portions of a single ply membrane of different heights, the adhesive does not conform to the vertical step in height thus causing bridging and leaving a void into which water and debris can enter.

SUMMARY OF THE INVENTION

When roofing membranes intersect or overlap with one another, joints may be formed at the points of intersection or overlap. A T-joint is a joint formed by the intersection or overlapping of three or four membrane sheets. A butt-joint is a joint formed by adjacent, separate sections of material, such as where two neighboring pieces of roofing membrane abut. The joints formed by the intersection and/or overlapping of roofing membranes can be problematic since the void formed by the joint permits water to seepage into and underneath the roofing membranes.

A joint patch is provided to alleviate the problem inherent in the formation of "joints" formed as a result of the overlapping intersection of sheets in the roofing membrane. In one embodiment, the T-joint patch is ribbed and may be circular, oval, square or rectangle. The patch is comprised of a single ply roofing membrane preferably ranging in size from approximately 3 inches to 9 inches. Examples of single ply roofing membranes from which the patch is formed includes, but is not limited to, thermoplastic olefin (TPO), polyvinyl chloride (PVC), ethylene propylene diene terpolymer (EPDM) or chlorosulfonated polyethylene (Hypalon®).

The joint patch can be injection molded or fabricated by other conventionally known methods, with a rib or similar design having an approximate height of 20-90 mils on the flat plane of the membrane that will receive a butyl or other type of adhesive compound and a release liner. This design will allow for the adhesive to fill in the void created by the overlapping membranes thus assuring a tight seal.

DETAILED DESCRIPTION

Figure 1:
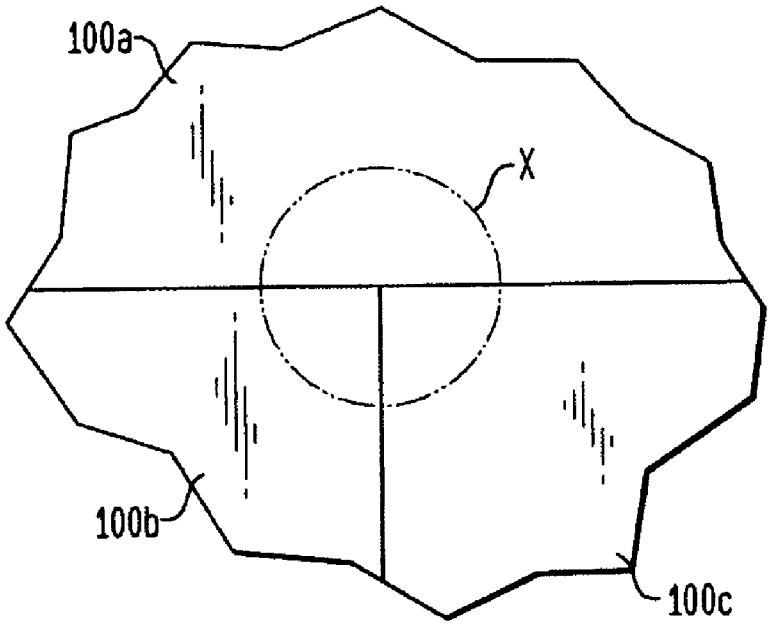
FIG. 1 depicts overlapping membranes forming a T-joint or void.
Figure 2:
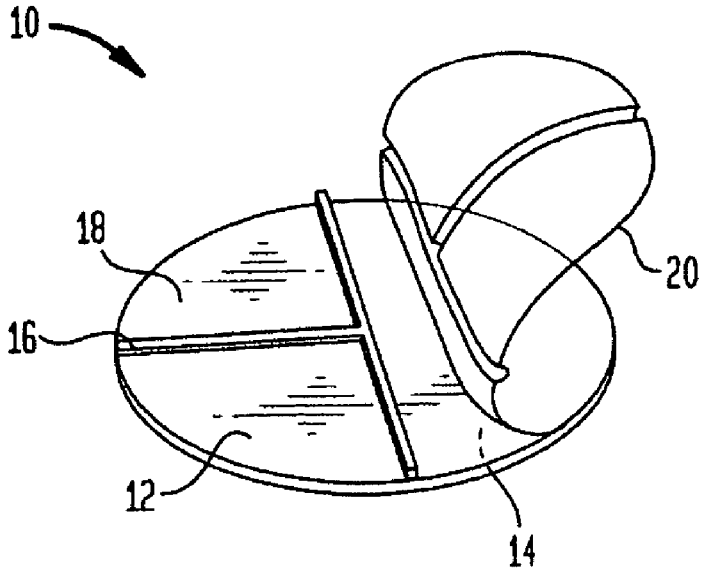
FIG. 2 is a perspective view of a circular T-joint patch in accordance with one embodiment of the present invention.

In FIG. 1, a joint, commonly referred to as a T-joint, (indicated by the circle denoted X) is formed by the intersection of three (3) membranes 100*a*, 100*b*, 100*c*. A first embodiment of the T-joint patch 10 is illustrated in FIG. 2. Patch 10 in one embodiment is circular or oval. Patch 10 is planar and has a first side 12 (roof side) and a second side 14 (weather side). A T-shaped rib 16 is positioned on first side 12. T-shaped rib 16 divides first side 12 of patch 10 into three sections. A layer of adhesive 18 such as a butyl layer or other similar waterproofing adhesive layer, is then coated on T-shaped 16 and first side 12 of patch 10. A release liner 20 is then positioned on first side 12 of patch 10 and conforms to the shape of patch 10. Patch 10 is not limited to a circular or oval shape and may also be square or rectangular.

Figure 3:
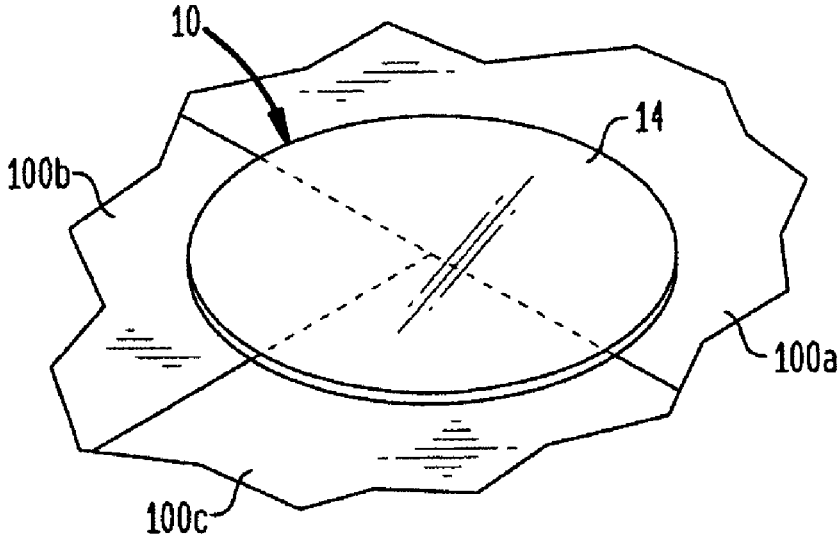
FIG. 3 illustrates a top view of the T-joint patch of FIG. 2 secured in the T-joint formed by the overlapping membranes.
Figure 4:
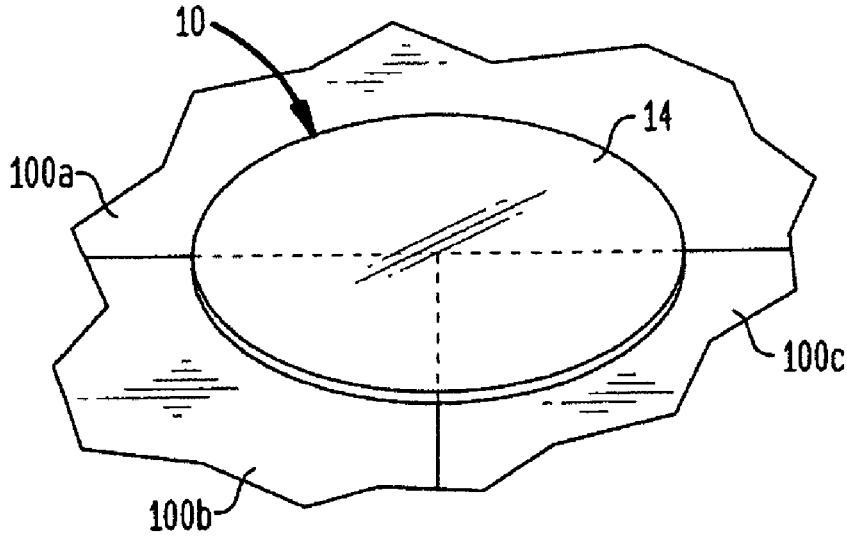
FIG. 4 illustrates another top view of the T-joint patch of FIG. 2 secured in the T-joint formed by the overlapping membranes.

In use, release liner 20 is peeled or removed from first side 12 of patch 10. The T-shaped rib 16 is then positioned to conform with the T-joint formed by the intersection of membranes 100*a*, 100*b*, 100*c* and is fitted in the T-joint. Adhesive layer 18 on first side 12 of patch 10 secures side 12 of patch 10 to membranes 100*a*, 100*b*, 100*c*. To provide a water-tight seal, pressure is usually applied to second side 14 of patch 10. Pressure may be applied by any known means, including the use of a roller or by applying pressure using one's hands. Heat may also be applied to second side 14 of patch 10 to provide a heat seal. FIGS. 3 and 4 illustrate patch 10 applied on membranes 100*a*, 100*b*, 100*c*. T-shaped rib is positioned in T-shaped joint (not visible), and adhesive layer 12 secures first side 12 of patch 10 to membranes 100*a*, 100*b*, 100*c*, leaving second side 14 as the exposed surface.

T-joint patch 10, in one embodiment, is a single ply roofing membrane ranging in size from approximately 3 inches to 9 inches, but the size and shape of the patch is not limited in this respect. Examples of single ply roofing membranes from which patch 10 is formed include thermoplastic olefin (TPO), polyvinyl chloride (PVC), ethylene propylene diene terpolymer (EPDM) or chlorosulfonated polyethylene (Hypalon®). The T-joint patch can be vacuum or injection molded, or fabricated by other conventionally known methods, with a T-shaped rib having an approximate height of 20-90 mils on the flat plane of the membrane that will receive a butyl or other type of adhesive compound and a release liner.

Figure 5:
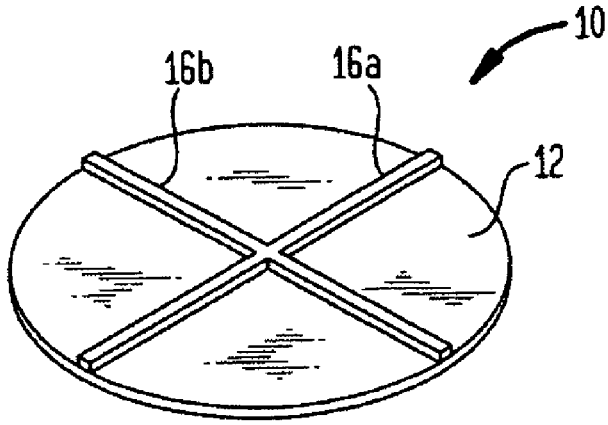
FIG. 5 illustrates a view of the roof side of a joint patch having two ribs which segment the patch into four quadrants.

In a second embodiment illustrated in FIG. 5, joint patch 10 is vacuum or injection molded and segmented (or divided) into four quadrants by intersecting ribs 16, 16*b*. Each quadrant formed by the intersection of ribs 16*a*, 16*b* have a different height and having the same thickness of butyl or other adhesive layer thereon, along with a release liner (not shown).

In a third embodiment, joint patch is segmented into four quadrants as in FIG. 5. In this embodiment, the four quadrants formed by intersecting ribs, combined with the butyl layer (or other adhesive layer), and the release liner, all have a different thickness. The difference in the thickness of the quadrants is to accommodate the differences in height of intersecting roofing membranes, which are oftentimes placed on top of one another such that one or more sides of a of a joint may be higher than other sides.

Figure 6:
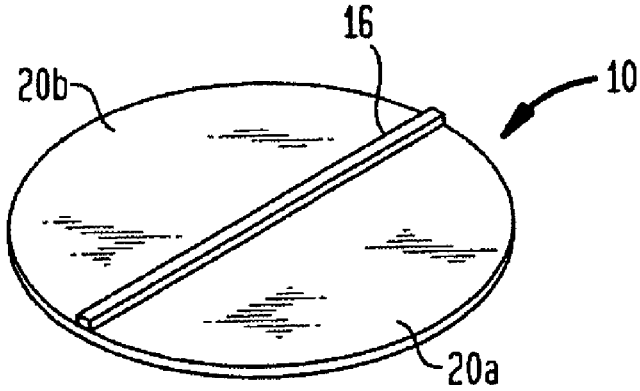
FIG. 6 illustrates a top view of the a joint patch in which a single rib, segmenting the patch into halves, is seen in skeletal view.
Figure 7:
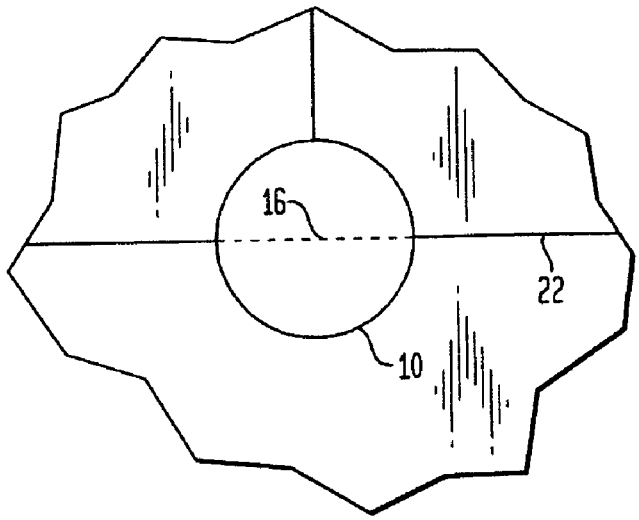
FIG. 7 illustrates a top view of the joint patch of FIG. 6 secured in the joint formed by the overlapping membranes.

In another embodiment illustrated in FIG. 6, a joint patch 10 is segmented into two sections 20*a*, 20*b* by a single rib 16. Sections 20*a* and 20*b* may or may not be equal halves. Each of sections 20*a*, 20*b* are provided with a butyl layer or other adhesive layer, and a release liner. Furthermore, each of sections 20*a*, 20*b* has a different thickness. FIG. 7 illustrates joint patch 10 of FIG. 6 applied on membranes 100*a*, 100*b*, 100*c* in a horizontal joint 22.

In another embodiment in accordance with the present invention, patch 10 may be used for sealing a butt joint formed by adjacent, separate sections of material, such as roofing membrane sheets. A butt joint patch generally has a single rib on the deck side of the patch and extending from one side of the patch to the other side, much like patch 10 illustrated in FIGS. 6 and 7. The single rib on the deck side of the patch generally splits butt joint patch into two equal sections, however the invention is not limited in this respect, and rib may divide butt joint patch into unequal sections. As with the other joint patches described herein, the butt joint patch will also be provided on its deck side with a butyl layer or other adhesive layer, and a release liner on the butyl or other adhesive layer. The butt joint patch in accordance with the present invention can be vacuum molded, injection molded or fabricated by other conventionally known methods.

Figure 8:
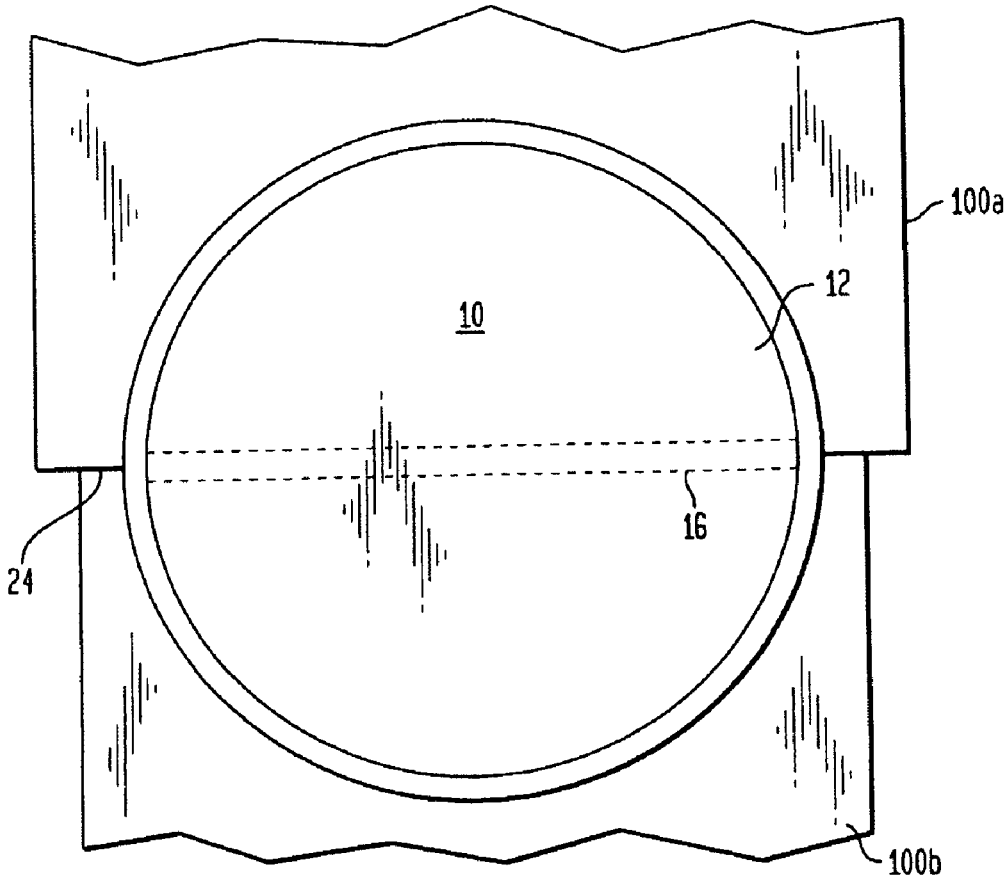
FIG. 8 illustrates a top view of a butt-joint patch secured in the joint formed by the overlapping membranes.

FIG. 8, illustrates butt joint patch 10 having a single rib 16 on its deck side positioned in a butt joint 24 formed by the intersection/overlapping of membrane 100*a* and 100*b*.

In still another embodiment there is provided a butt joint patch having a vacuum or injection molded membrane having a single rib 16 which segments the membrane into two sections of two different heights, each segment having the same thickness of butyl or other adhesive layer thereon, along with a release liner.

What is claimed is:

1. A roof joint patch, comprising:

a. a flat section of roofing membrane to be applied to a joint formed by two or more membranes;

b. one or more ribs positioned on the surface of one side of the section of roofing membrane, the ribs conforming to the joint thereby forming a tight seal;

c. an adhesive waterproofing layer applied on the flat section of roofing membrane having the rib positioned thereon; and d. a release liner applied on the adhesive layer.

2. The joint patch as recited in claim 1, wherein the flat section of roofing membrane is circular, oval, square or rectangular in shape.

3. The joint patch as recited in claim 2, wherein the flat section of the roofing membrane is circular or oval.

4. The joint patch as recited in claim 1, wherein the flat section of roofing membrane is a single ply roofing membrane selected from the group consisting of: thermoplastic olefin, polyvinyl chloride, ethylene propylene diene terpolymer or chlorosulfonated polyethylene.

5. The joint patch as recited in claim 4, wherein the single ply roofing membrane is vacuum or injection molded.

6. The joint patch as recited in claim 1, wherein the flat section of roofing membrane ranges in size from approximately 3-9 inches.

7. The joint patch as recited in claim 1, wherein the one or more ribs has a height in the range of approximately 20-90 mils.

8. The joint patch as recited in claim 1, wherein the adhesive layer is a butyl layer or other similar waterproofing compound.

9. The joint patch as recited in claim 1, wherein the one or more ribs segment the patch into two, three or four sections.

10. The joint patch as recited in claim 9, wherein each of the sections on the patch are provided with the adhesive waterproofing layer and a release liner, and wherein each section has a different height.

11. The joint patch as recited in claim 10, wherein the one or more ribs have a height in the range of approximately 20-90 mils.

12. The joint patch as recited in claim 10, wherein the adhesive layer is a butyl layer.

13. The joint patch as recited in claim 10, wherein the flat section of singly ply roofing membrane is circular or oval.

14. The joint patch as recited in claim 10, wherein the flat section of single ply roofing membrane is square or rectangular in shape.

15. The joint patch as recited in claim 9, wherein each of the sections on the patch are provided with the adhesive waterproofing layer and a release liner, and wherein the thickness of the adhesive waterproofing layer and the release liner on each section is different.

16. The joint patch as recited in claim 1, wherein the two or more membranes are overlapping roofing membrane sheets, and the one or more ribs are positioned to conform to the joint formed by the overlapping roofing membrane sheets such that the rib on the patch fills in the joint to create a water tight seal.

17. The joint patch as recited in claim 16, wherein the joint is a T-joint or a butt joint.

18. The joint patch as recited in claim 16, wherein the single ply roofing membrane is vacuum or injection molded.

19. The joint patch as recited in claim 16, wherein the flat section of single ply roofing membrane ranges in size from approximately 3-9 inches.

20. A T-joint patch, comprising:

a. a flat section of roofing membrane to be applied to a T-joint formed by two or more membranes;

b. a T-shaped rib positioned on the surface of one side of the flat section of roofing membrane, the T-shaped rib conforming to the T-joint thereby forming a tight seal;

c. an adhesive waterproofing layer applied on the flat section of roofing membrane having the T-shaped rib positioned thereon; and d. a release liner applied on the adhesive layer.

21. The T-joint patch as recited in claim 20, wherein the flat section of roofing membrane is circular, oval, square or rectangular in shape.

22. The T-joint patch as recited in claim 21, wherein the flat section of the roofing membrane is circular or oval.

23. The T-joint patch as recited in claim 20, wherein the flat section of roofing membrane is a single ply roofing membrane selected from the group consisting of: thermoplastic olefin, polyvinyl chloride, ethylene propylene diene terpolymer or chlorosulfonated polyethylene.

24. The T-joint patch as recited in claim 23, wherein the single ply roofing membrane is vacuum or injection molded.

25. The T-joint patch as recited in claim 20, wherein the flat section of roofing membrane ranges in size from approximately 3-9 inches.

26. The T-joint patch as recited in claim 20, wherein the T-shaped rib has a height in the range of approximately 20-90 mils.

27. The T-joint patch as recited in claim 20, wherein the adhesive layer is a butyl layer or other similar waterproofing compound.

28. The T-joint patch as recited in claim 20, wherein the two or more membranes are intersecting and/or overlapping roofing membranes, and the T-shaped rib is positioned to conform to the T-joint formed by the intersecting and/or overlapping roofing membranes such that the T-shaped rib on the T-joint patch fills in the T-shaped joint to create a water tight seal.

29. The T-joint patch as recited in claim 20, wherein the T-shaped rib segments the patch into three sections.

30. The T-joint patch as recited in claim 29, wherein each of the three sections are provided with the adhesive waterproofing layer and the release liner, and wherein each section has a different height.

31. The T-joint patch as recited in claim 29, wherein each of the three sections are provided with the adhesive waterproofing layer and the release liner, and wherein the thickness of the adhesive waterproofing layer and the release liner on each segment is different.

32. A roof joint patch, comprising:

a. a flat section of roofing membrane to be applied to a joint formed by two or more membranes;

b. one or more ribs positioned on the surface of one side of the section of roofing membrane and which segments the roofing membrane into 2, 3 or 4 sections, the ribs conforming to the joint thereby forming a tight seal;

c. an adhesive waterproofing layer applied on the flat section of roofing membrane having the rib positioned thereon; and d. a release liner applied on the adhesive layer.

33. The joint patch as recited in claim 32, wherein the flat section of roofing membrane is circular, oval, square or rectangular in shape.

34. The joint patch as recited in claim 33, wherein the flat section of the roofing membrane is circular or oval.

35. The joint patch as recited in claim 33, wherein the flat section of roofing membrane is a single ply roofing membrane selected from the group consisting of: thermoplastic olefin, polyvinyl chloride, ethylene propylene diene terpolymer or chlorosulfonated polyethylene.

36. The joint patch as recited in claim 35, wherein the single ply roofing membrane is vacuum or injection molded.

37. The joint patch as recited in claim 32, wherein the flat section of roofing membrane ranges in size from approximately 3-9 inches.

38. The joint patch as recited in claim 32, wherein the one or more ribs have a height in the range of approximately 20-90 mils.

39. The joint patch as recited in claim 32, wherein the adhesive layer is a butyl layer or other similar waterproofing compound.

40. The joint patch as recited in claim 32, wherein each of the sections on the patch are provided with the adhesive waterproofing layer and a release liner, and wherein each section has a different height.

41. The joint patch as recited in claim 32, wherein each of the sections on the patch are provided with the adhesive waterproofing layer and a release liner, and wherein the thickness of the adhesive waterproofing layer and the release liner on each section is different.

42. The joint patch as recited in claim 32, wherein the two or more membranes are intersecting and/or overlapping roofing membrane sheets, and the one or more ribs are positioned to conform to the joint formed by the intersecting and/or overlapping roofing membrane sheets such that the rib on the patch fills in the joint to create a water tight seal.

43. The joint patch as recited in claim 42; wherein the joint is a T-joint or a butt joint.

44. A butt joint patch, comprising:

a. a flat section of roofing membrane to be applied to a butt joint formed by two or more membranes;

b. a single rib positioned on the surface of one side of the flat section of roofing membrane, the rib segmenting the surface of the flat section of roofing membrane into two sections, the single rib conforming to the butt joint thereby forming a tight seal;

c. an adhesive waterproofing layer applied on the flat section of roofing membrane having the rib positioned thereon; and d. a release liner applied on the adhesive layer.

45. The butt joint patch as recited in claim 44, wherein the flat section of roofing membrane is circular, oval, square or rectangular in shape.

46. The butt joint patch as recited in claim 45, wherein the flat section of the roofing membrane is circular or oval.

47. The butt joint patch as recited in claim 44, wherein the flat section of roofing membrane is a single ply roofing membrane selected from the group consisting of: thermoplastic olefin, polyvinyl chloride, ethylene propylene diene terpolymer or chlorosulfonated polyethylene.

48. The butt joint patch as recited in claim 47, wherein the single ply roofing membrane is vacuum or injection molded.

49. The butt joint patch as recited in claim 44, wherein the flat section of roofing membrane ranges in size from approximately 3-9 inches.

50. The butt joint patch as recited in claim 44, wherein the T-shaped rib has a height in the range of approximately 20-90 mils.

51. The butt joint patch as recited in claim 44, wherein the adhesive layer is a butyl layer or other similar waterproofing compound.

52. The butt joint patch as recited in claim 44, wherein the two or more membranes are intersecting and/or overlapping roofing membrane sheets, and the rib is positioned to conform to the butt joint formed by the intersecting and/or overlapping roofing membranes such that the rib on the butt joint patch fills in the joint to create a water tight seal.

53. The butt joint patch as recited in claim 44, wherein each of the two sections are provided with the adhesive waterproofing layer and the release liner, and wherein each section has a different height.

54. The butt joint patch as recited in claim 44, wherein each of the two sections are provided with the adhesive waterproofing layer and the release liner, and wherein the thickness of the adhesive waterproofing layer and the release liner on each segment is different.

* * * * *